US006012988A

United States Patent [19]

Burke

[11] Patent Number: 6,012,988

[45] Date of Patent: Jan. 11, 2000

[54] GOLF CLUB WITH OVERSWING ALERTING MECHANISM

[76] Inventor: Thomas J. Burke, 5 Matheson Rd., Whitehouse Station, N.J. 08889

[21] Appl. No.: 09/133,236

[22] Filed: Aug. 13, 1998

[51] Int. Cl.[7] ..... A63B 39/36

[52] U.S. Cl. ..... 473/224; 473/234

[58] Field of Search ..... 473/224, 223, 473/233, 234

[56] References Cited

U.S. PATENT DOCUMENTS

| | | | |
|---|---|---|---|
| 1,549,350 | 8/1925 | Deike . | |
| 2,064,603 | 12/1936 | Harrison . | |
| 2,191,683 | 2/1940 | Roberts . | |
| 2,388,463 | 11/1945 | Benecke . | |
| 3,730,530 | 5/1973 | Oka et al. . | |
| 3,776,556 | 12/1973 | McLaughlin . | |
| 3,808,707 | 5/1974 | Fink . | |
| 4,283,057 | 8/1981 | Ragan . | |
| 5,165,683 | 11/1992 | Beutler et al. . | |
| 5,184,826 | 2/1993 | Hall | 473/224 |
| 5,236,192 | 8/1993 | Pitzel . | |
| 5,259,620 | 11/1993 | Marocco | 473/224 |
| 5,419,562 | 5/1995 | Cromarty . | |
| 5,435,561 | 7/1995 | Conley | 473/224 |

*Primary Examiner*—George J. Marlo
*Attorney, Agent, or Firm*—Frommer Lawrence & Haug LLP

[57] ABSTRACT

A golf club with overswing alerting mechanism is provided which produces an audible sound upon the occurrence of an overswing condition. In this golf club, the overswing alerting mechanism is housed entirely within the hollow opening of the golf club shaft. This overswing alerting mechanism includes a sound generation assembly for generating an audible sound upon occurrence of the overswing condition; an energy generation member to provide electrical energy to the sound generation assembly, and a circuit closing member which closes the electrical circuit between the energy generation member and the sound generation assembly only upon the occurrence of an overswing condition.

12 Claims, 2 Drawing Sheets

GOLF CLUB WITH OVERSWING ALERTING MECHANISM

FIELD OF THE INVENTION

The present invention relates to the field of aids for assisting a golfer in obtaining a proper swinging movement of a golf club, and more particularly, relates to an overswinging alerting mechanism for a golf club or golf club practice aid which generates an audible sound to be heard by the golfer upon occurrence of improper swinging movement of the golf club.

BACKGROUND OF THE INVENTION

In the past, various devices have been employed to indicate an improper swinging movement of a golf club so that hopefully a golfer can perfect his swing. For instance, in U.S. Pat. No. 1,549,350 to Deike issued Aug. 11, 1925, a whistle is either secured within a recess of the golf club head (see FIG. 4 of Deike) or extended from the top of the golf club head (see FIG. 5 of Deike). This whistle produces the loudest sound at the point of greatest speed of the golf club, which Deike contends should occur at the time of contact of the golf club head with the golf ball. It has been found, however, that the proper golf swing is not necessarily purely dependent upon striking the golf ball at the maximum speed of the golf club.

In U.S. Pat. No. 4,283,057 to Ragan issued Aug. 11, 1981, a golf club is provided with an air flow hole through its head which contains a whistle which according to Ragan provides an indication of the smoothness and velocity of the swing based upon the turbulence of the ambient air at the air flow hole's outlet head. However, due to variables which determine air turbulence, such as wind gusts, etc., it has been found desirable to provide an overswing alerting mechanism which is not dependent upon the air turbulence of the ambient air.

Moreover, since the whistle in Ragan is provided in an air flow hole in the golf club head, the Ragan golf club can only be utilized as a golf practice device unless the Ragan club head employs a second whistle 6 which is provided in hole 12 and the first hole 4 and whistle 5 are eliminated as is shown in FIG. 5 of Ragan. In this embodiment, Ragan contends that sound output may be adequate in some instances if the upper end of the shaft is left open to provide an adequate flow of pressurized air. However, Ragan concedes that this golf club swing trainer will only provide a sound output that may be adequate in some instances, particularly when the golf club is swung in the absence of excessive background noise. However, in view of the many conditions in which golf is played, it has been found desirable to provide an overswing alerting mechanism which is not dependent upon the presence or absence of background noise.

In U.S. Pat. No. 3,730,530 to Oka et al. issued May 1, 1973, a golf swing training attachment is attached by a suction disk to the golf club head wherein a vibration plate emits a sound when the club head reaches a desirable speed. However, in view of the speed of swing of the golf club, such attachments have been found to fly off the golf club. Therefore, it has been found desirable to provide an overswing alerting mechanism for a golf club which is permanently mounted on or incorporated within a golf club.

In U.S. Pat. No. 3,776,556 to McLaughlin issued Dec. 4, 1973, an attachment is externally mounted on the golf club shaft which includes a pair of differently oriented and pitched whistles which McLaughlin contends do not emit a sound when the swing of the golf club is perpendicular to the club face but will emit differing sounds when there is a hook or a slice. However, the generation of sounds from the two whistles is only dependent upon the angle of the golf club face with respect to the intended swinging direction of the golf club. Accordingly, the McLaughlin golf club practice aid does not produce an audible sound merely upon the occurrence of an overswing condition.

Moreover, the United States Golf Association ("USGA") promulgates and administers the Rules of Golf in the United States. It is believed that each of the golf club practice devices mentioned above does not comply with at least one of the USGA's rules relating to improper equipment. For instance, the USGA Rules of Golf provide that, in general, the club must not have any external attachments (see USGA Rules of Golf 1998–1999, §4-1a). Therefore, it is believed that the golf club practice aids of U.S. Pat. Nos. 3,730,530, 3,776,556 and the aid of FIG. 6 of U.S. Pat. No. 1,549,350 do not comply with at least this USGA Rule. In addition, the USGA Rules of Golf provide that the club head cannot have holes therethrough as it must be generally plain in shape (see USGA Rules of Golf 1998–1999 §4-1d and App. II, §4-1d). Therefore, it is believed the golf club practice aids of U.S. Pat. No. 4,283,057 and the aid of FIGS. 1–4 of U.S. Pat. No. 1,549,350 do not comply with at least this USGA Rule. Under the USGA Rules of Golf, penalties, such as penalty strokes, etc., result from use of improper equipment. It has therefore been found desirable to provide an overswing alerting mechanism for a golf club which is believed to be in compliance with the current USGA Rules of Golf.

OBJECTS OF THE INVENTION

Therefore, it has been found desirable to provide an overswing alerting mechanism for a golf club which avoids the aforementioned disadvantages of the prior art.

An additional object of the present invention is to provide a golf club with overswing alerting mechanism which generates an audible sound upon occurrence of an overswing condition.

Another object of the present invention is to provide an overswing alerting mechanism which is not purely dependent upon the speed at which the golf ball is struck by the golf club.

A further object of the present invention is to provide an overswing alerting mechanism for a golf club which is not dependent upon the air turbulence of the ambient air to generate an audible sound upon the occurrence of an improper swinging condition.

Still another object of the present invention is to provide an overswing alerting mechanism for a golf club which is reliable in producing an audible sound upon the occurrence of an overswing condition regardless upon the presence or absence of background noise.

An additional object of the invention is to provide an overswing alerting mechanism for a golf club which is permanently incorporated within the golf club.

A further object of the present invention is to provide a golf club with overswing alerting mechanism which is believed to be in compliance with the current USGA Rules of Golf.

Various other objects, advantages and features of the present invention will become readily apparent from the ensuing detailed description and the novel features will be particularly pointed out in the appended claims.

SUMMARY OF THE INVENTION

In accordance with the present invention, a golf club with an overswing alerting mechanism is provided which produces an audible sound upon occurrence of an overswing condition. As is typical, this golf club includes a golf club shaft having a hollow opening extending therethrough and a golf club head supported on an end of the golf club shaft with the golf club head having a striking face for hitting the golf ball.

In accordance with one of the general objects of the present invention, the overswing alerting mechanism disclosed herein can be permanently incorporated within the golf club of the present invention. More particularly, the overswing alerting mechanism of the present invention is housed entirely within the hollow opening of the golf club shaft. This overswing alerting mechanism includes a sound generation assembly for generating an audible sound upon occurrence of the overswing condition. In a preferred embodiment, this sound generation assembly is in the form of a horn provided within the hollow opening of the golf club shaft.

In order to provide electrical energy to the sound generation assembly, an energy generation member is electrically connected thereto and supported within the hollow opening of the golf club shaft. In a preferred embodiment, the energy generation member is in the form of two 1-½ volt hearing aid batteries.

In order to activate the energy generation member only upon the occurrence of an overswing condition, the overswing alerting mechanism for the golf club of the present invention includes a circuit activating or closing member provided in the hollow opening of the golf club shaft. In one embodiment, this circuit closing member includes a weight member which upon the occurrence of an overswing condition closes a contact member which in turn impinges upon a contact adjustment screw/switch to complete an electrical circuit such that an audible sound is generated by the sound generation assembly. More particularly, the weight member and the contact member are positioned within the hollow opening of the golf club shaft so that the weight member will only close the contact member if the golf club is overswung.

In another preferred embodiment, the circuit closing member includes an electronic transducer which is electrically connected between the energy generation member and the sound generation assembly. Upon sensing an overswing condition of the golf club, the electronic transducer completes an electrical circuit such that an audible sound is generated by the sound generation assembly.

Accordingly, a preferred embodiment of a golf club with overswing alerting mechanism has been designed which is believed to be in compliance with the current Rules of Golf of the United States Golf Association as the overswing alerting mechanism is not externally attached, as it is entirely housed within the hollow opening of the golf club shaft, and in addition, the club head remains plain in shape (i.e., with no holes therethrough).

BRIEF DESCRIPTION OF THE DRAWINGS

The following detailed description, given by way of example, will best be understood in conjunction with the accompanying drawing in which.

DETAILED DESCRIPTION OF CERTAIN PREFERRED EMBODIMENTS OF THE INVENTION

Figure 1:
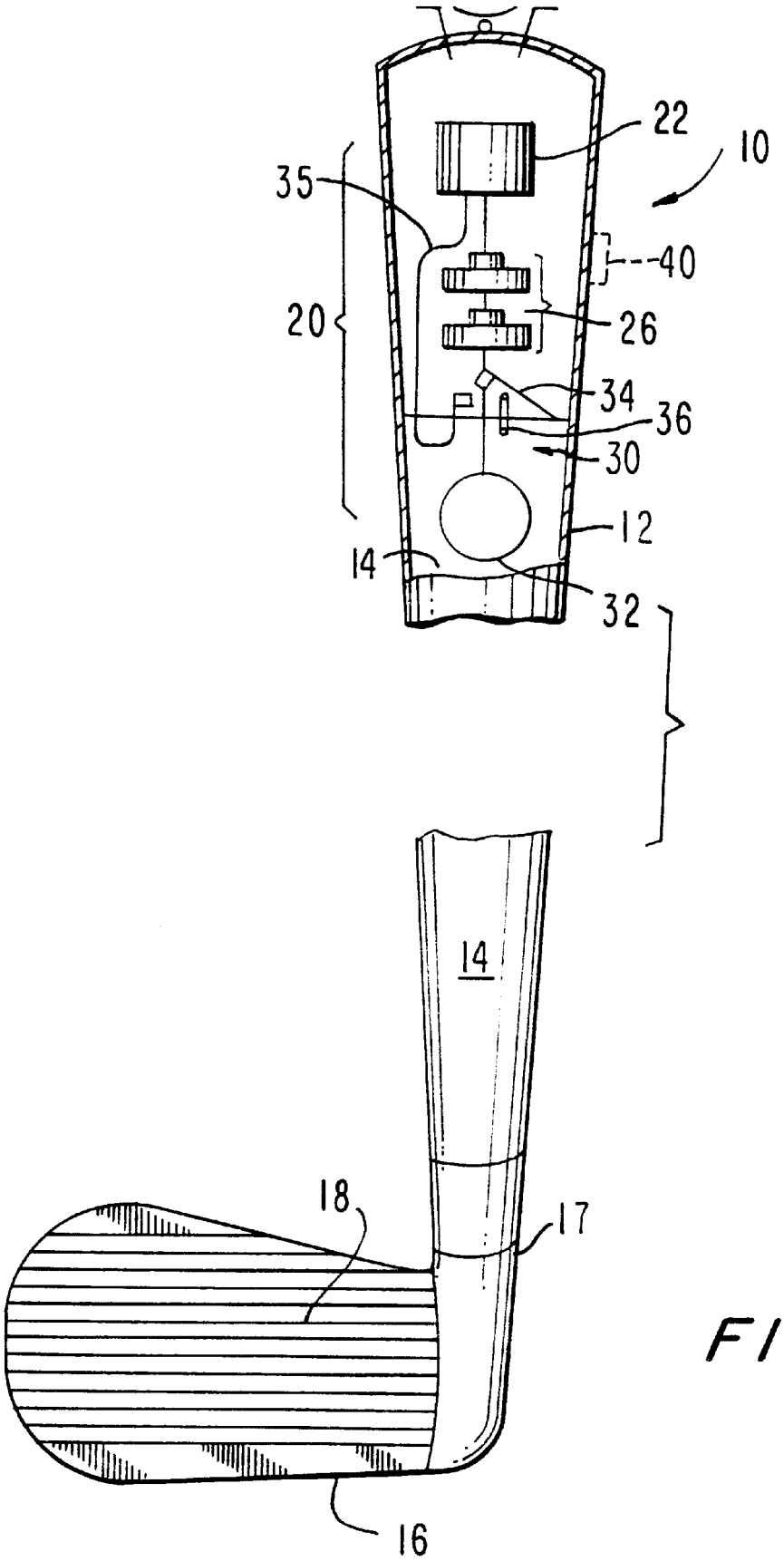
FIG. 1 is a front elevational view in cross-section of a preferred embodiment of a golf club with overswing alerting mechanism in accordance with the teachings of the present invention.

Referring now to the drawings, there is illustrated a preferred embodiment of a golf club having an overswing alerting mechanism in accordance with the present invention. As is described below, this golf club with overswing alerting mechanism produces an audible sound upon the occurrence of an overswing condition of the golf club.

As is shown in FIG. 1, the golf club 10 of the present invention generally includes a golf club shaft 12 having a hollow opening 14 extending therethrough for the length thereof and a golf club head 16 supported on an end 17 of the golf club shaft 12 with the golf club head 16 having a striking face 18 for hitting the golf ball.

In order to alert the golfer that the golf club has been overswung, an overswing alerting mechanism, generally referred to by reference numeral 20 in FIG. 1, is permanently incorporated within the golf club 10 of the present invention. In order to prevent the overswing alerting mechanism 20 from altering the golfer's swing, the overswing alerting mechanism 20 of the present invention is housed entirely within the hollow opening 14 of the golf club shaft 12.

As is shown in FIG. 1, the overswing alerting mechanism 20 includes a sound generation assembly 22 for generating an audible sound upon the occurrence of an overswing condition. In the preferred embodiment, the sound generation assembly 22 is in the form of a horn but it can be any electrically-operated device which can emit an audible sound. As is shown in FIG. 1, the sound generation assembly 22 is sized to fit within the hollow opening 14 of the golf club shaft 12.

In order to provide electrical energy to the sound generation assembly 22, an energy generation member 26 is electrically connected thereto and supported within the hollow opening 14 of the golf club shaft 12. In the preferred embodiment, the energy generation member 26 is in the form of two 1-½ volt hearing aid batteries. However, any power supply which can be sized to be accommodated within the hollow opening 14 of the golf club shaft 12 and still provide sufficient electrical power to the sound generation assembly 22 may be employed.

As is shown in FIG. 1, the overswing alerting mechanism 20 for a golf club of the present invention also includes a circuit activating or closing member 30 provided in the hollow opening 14 of the golf club shaft 12 which activates the energy generation member 26 only upon the occurrence of an overswing condition. More particularly, this circuit closing member 30 includes a weight member 32 which, upon the occurrence of an overswing condition, closes a contact member 34, which in turn, contacts a contact adjustment screw/switch 36 which is electrically connected to the sound generation assembly 22 by means of electrical wiring 35. Accordingly, the electrical circuit between the energy generation member 26 and the sound generation assembly 22 is closed to thereby generate an audible sound from the sound generation assembly 22. As shown in FIG. 1, the weight member 32 and contact member 34 are positioned within the hollow opening 14 of the golf club shaft 12 so that the weight member 32 will only close the contact member 34, and thus close the electrical circuit between the energy generation assembly 26 and the sound generation assembly 22, if the golf club is overswung.

Figure 2:
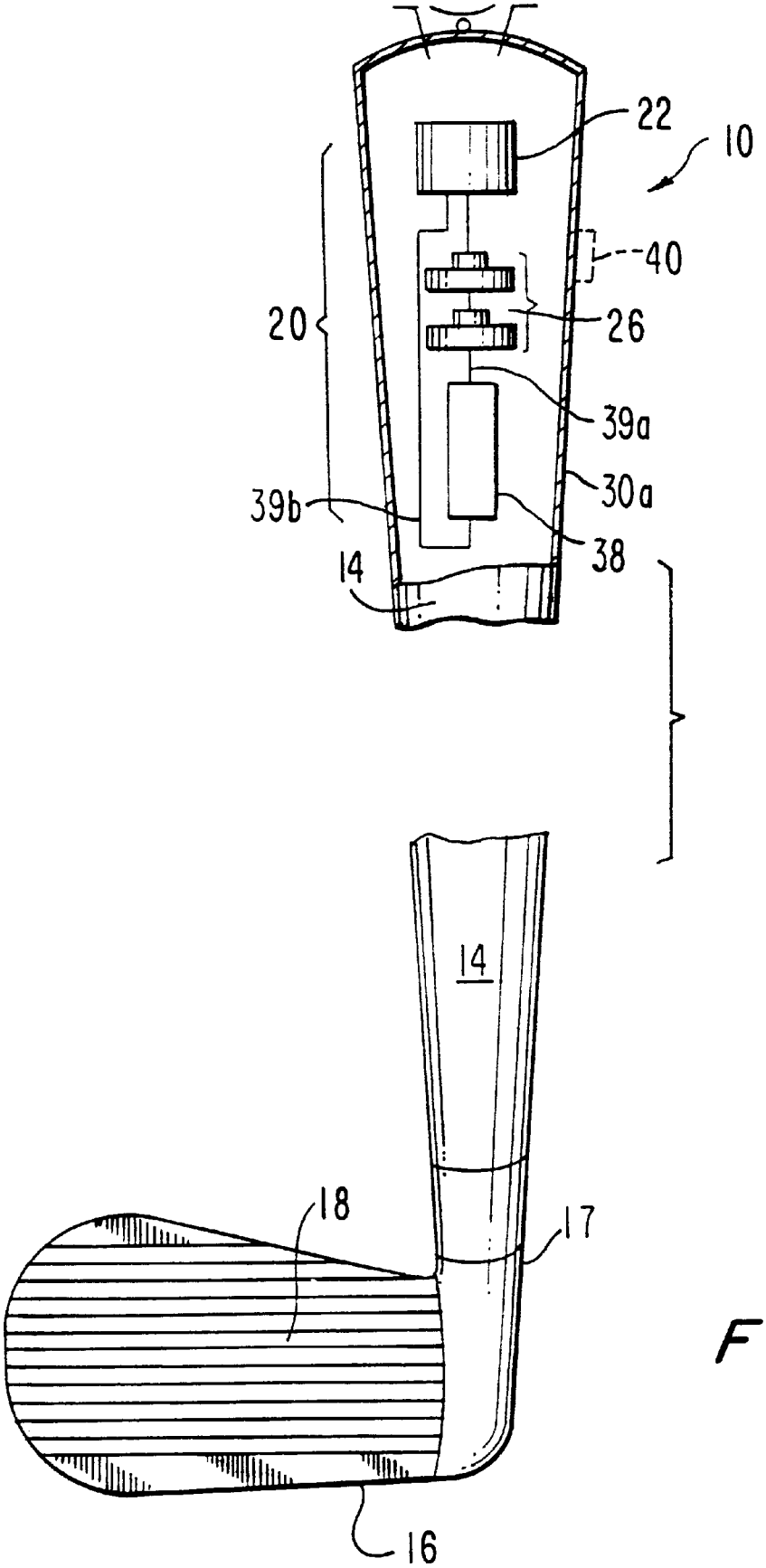
FIG. 2 is a front elevational view in cross-section of another preferred embodiment of a golf club with overswing alerting mechanism in accordance with the teachings of the present invention.

Another preferred embodiment of the circuit closing member for the overswing alerting mechanism for a golf club of the present invention is shown in FIG. 2. In this embodiment, the circuit closing member 30*a* includes an electronic transducer 38 which is electrically connected between the energy generation member 26 and the sound generation assembly 22 by means of electrical wiring 39*a* and *b*. Upon sensing an overswing condition of the golf club, the electronic transducer 38 closes the electrical circuit such that an audible sound is generated by the sound generating assembly 22.

Based upon the foregoing, it will be appreciated that the golf club with overswing alerting mechanism of the present invention generates an audible sound upon occurrence of an overswing condition. Moreover, the generation of the audible sound of the overswing alerting mechanism of the present invention is not purely dependent upon the speed at which the golf ball is struck by the golf club as instead an audible sound is generated if the golf club is overswung.

Further, since the overswing alerting mechanism of the present invention is not in the form of a whistle, it is not dependent upon the air turbulence of the ambient air. In addition, in order that the golf club with overswing alerting mechanism of the present invention can be used for either practice or play, it is permanently incorporated within the golf club.

Moreover, it is believed that the preferred embodiments of a golf club with overswing alerting mechanism of the present invention set forth above comply with the current USGA Rules of Golf relating to golf equipment. In this regard, it is not externally attached, as it is entirely housed within the hollow opening 14 of the golf club shaft, and in addition, the club head remains generally plain in shape (i.e., it requires no holes through the club head).

In a further embodiment, as shown in the dotted line in FIG. 1, an on-off switch 40 can be attached to the golf club shaft 12 for activating and deactivating the overswing alerting mechanism 20 when desired.

While the present invention has been particularly shown and described with reference to certain preferred embodiments, it will be readily apparent to those of ordinary skill in the art that various changes and modifications may be made therein without departing from the sprit and scope of the invention. It is intended that the appended claims be interpreted as including the foregoing as well as various other such changes and modifications.

What is claimed is:

1. A golf club comprising:

a golf club shaft having a hollow opening extending therethrough;

a golf club head supported on an end of said golf club shaft with said golf club head having a striking face for hitting a golf ball; and means for alerting the user as to an overswing condition of the golf club head with said overswing alerting means being housed entirely within said hollow opening of said golf club shaft, said overswing alerting means including sound generation means for generating a sound upon the occurrence of an overswing condition and energy means for providing electrical energy to said sound generation means, said overswing alerting means further including circuit closing means for electrically connecting said energy means with said sound generating means, said circuit closing means including a weight member which upon occurrence of the overswing condition closes a contact member and impinges upon a contact adjustment screw/switch completes an electrical circuit between said energy means and said sound generation means to thereby generate a sound from said sound generation means.

2. The golf club of claim 1 wherein said sound generation means includes a horn.

3. The golf club of claim 1 wherein said energy means is a pair of 1-½ volt batteries.

4. The golf club of claim 1 and further comprising an on-off switch attached to said golf club shaft for activating and deactivating said overswing alerting means when desired.

5. A golf club comprising:

a golf club shaft having a hollow opening extending therethrough;

a golf club head supported on an end of said golf club shaft having a striking surface for hitting a golf ball; and means for alerting the user as to an overswing condition of the golf club head including sound generation means for generating a sound upon occurrence of the overswing condition, energy means for providing electrical energy to said sound generation means, and circuit closing means for electrically connecting said energy means with said sound generation means wherein said circuit closing means includes a weight member which upon the occurrence of the overswing condition closes a contact member which impinges upon a contact adjustment screw/switch which completes electrical circuit between said energy means and said sound generation means to thereby generate a sound from said sound generation means.

6. The golf club of claim 5 wherein said overswing alerting means is housed entirely within said hollow opening of said golf club shaft.

7. The golf club of claim 5 wherein said sound generation means includes a horn.

8. The golf club of claim 5 wherein said energy means includes a pair of 1-½ volt batteries.

9. The golf club of claim 5 and further comprising an on-off switch attached to said golf club shaft for activating and deactivating said overswing alerting means when desired.

10. An overswing alerting mechanism for alerting a user to an overswing of a golf club comprising sound generation means for generating a sound upon occurrence of the overswing condition, energy means for providing electrical energy to said sound generation means, and circuit closing means for electrically connecting said energy means with said sound generation means wherein said sound generation means, said energy means and said circuit closing means can be entirely housed within a hollow opening of a golf club shaft, and wherein said circuit closing means includes a weight member which upon occurrence of an overswing condition closes a contact member which impinges upon a contact adjustment screw/switch which completes an electrical circuit between said energy means and said sound generation means to thereby generate a sound from said sound generation means.

11. The overswing alerting mechanism of claim 10 wherein said sound generation means includes a horn.

12. The overswing alerting mechanism of claim 10 wherein said energy means includes a pair of 1-½ volt batteries.

* * * * *